United States Patent [19]

Doorenbos

[11] Patent Number: 4,637,532

[45] Date of Patent: Jan. 20, 1987

[54] DEVICE FOR ASSISTING IN PUTTING ON ELASTIC HOSIERY

[76] Inventor: Daryl E. Doorenbos, R.R. 2, Box 85A, Le Mars, Iowa 51031

[21] Appl. No.: 839,147

[22] Filed: Mar. 13, 1986

[51] Int. Cl.[4] ..... A47G 25/90

[52] U.S. Cl. ..... 223/111; 223/112

[58] Field of Search ..... 223/111, 112, 60, 75–77, 223/118, 119, 117

[56] References Cited

U.S. PATENT DOCUMENTS

| | | | |
|---|---|---|---|
| 2,443,115 | 6/1948 | Park | 223/111 |
| 2,796,207 | 6/1957 | Young | 223/111 |
| 2,828,057 | 3/1958 | MacLauchlan | 223/111 |
| 3,231,160 | 1/1966 | Glanville | 223/111 |
| 4,066,194 | 1/1978 | Leland | 223/111 |
| 4,260,083 | 4/1981 | Aslin | 223/111 |
| 4,284,216 | 8/1981 | Leland | 223/111 |
| 4,421,259 | 12/1983 | Sewell et al. | 223/112 X |

FOREIGN PATENT DOCUMENTS

| | | | |
|---|---|---|---|
| 446930 | 5/1936 | United Kingdom | 223/111 |

*Primary Examiner*—Louis K. Rimrodt
*Assistant Examiner*—Andrew M. Falik

[57] ABSTRACT

A device to assist in the donning of elastic hosiery. The device includes a form for holding the hosiery, one part of which can be spread from the rest to open and stretch the hosiery. The device is elongated to be used in the same manner as a shoehorn. A base may be provided so that the spreading can be foot operated or power operated by use of a hydraulic, pneumatic or mechanical means. The device also is formed so that the stocking will be releasably retained on the device while the ease of sliding the foot into the stocking is enhanced.

10 Claims, 4 Drawing Figures

DEVICE FOR ASSISTING IN PUTTING ON ELASTIC HOSIERY

BACKGROUND AND SUMMARY OF THE INVENTION

This invention pertains to devices to assist in the putting on of elastic stockings or similar leg coverings, and more particularly to such a device which can be operated to stretch open the stocking and hold it open while inserting the foot and leg into the stocking.

Many people because of some disability have difficulty putting stockings on their feet. This problem is particularly noticeable in the use of elastic stockings used for anti-embolism use, for control of varicose veins or similar circulatory problems. But it is also evident in cases where an individual is not able to bend over far enough to pull on a sock or stocking.

In the past there have been several proposals to ease the problem for those unable to bend. Most of these involved the use of extensions for the arms of the user either by handles or some sort of pulling device or by using straps or garter-like mechanisms to allow the user to exert pulling force on the tops of the garment. These devices do not work satisfactorily with elastic hosiery because they do not open, or open only the very end of the stocking for the insertion of the leg of the user.

By my device I provide principally a device to open the stocking so that the foot and leg can easily slide into the opening. It is easily possible to add handles or the like to provide added reach, but in most cases that would be unnecessary.

A more complete understanding of my invention in its embodiment may be gained from the following descriptions and figures, in which:

FIGURES

DESCRIPTION

Figure 1:
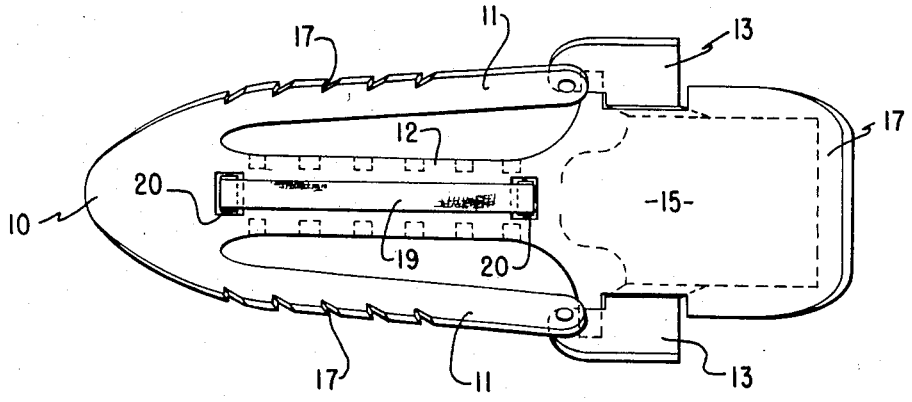
FIG. 1 is a top plan view of the device of my invention.

Briefly, my invention comprises a device over which a stocking may be placed, the stocking is then stretched open by a foot operated tongue. The foot can then be inserted into the opened stocking which will slide off from the serrated holder onto the leg of the user.

More specifically, and referring to the drawings, the device is formed principally of an elongated piece of flat plastic material having a rounded end 10 and elongated side rails 11. Between the rails 11, extends a tongue 12, also formed of the same plastic piece. Although I prefer to use a plastic material, it will be obvious that the material is a matter of choice and is not critical to the operation of the device.

A stand having legs 13 and a base 14 is either affixed to is formed as a part of the rails 11. This stand is shaped so as to hold one end of the rails 11 above the base 12 while the rounded end 10 is at the same level as the base, thus forming an inclined plane. The rails 11 may also be tilted somewhat so as to form a slight trough with the tongue 12 as the bottom of the trough.

The tongue 12 extends from tip 10 as a fairly narrow strip to provide some flexibility. However, it is broadened between the legs 13 so as to slide in engagement with those legs. The legs are also somewhat springable so that they press against the edges of the broadened portion 15 of the tongue. Notches 16 formed in the leg's inner surface (FIG. 3) are adapted to catch the edges of the tongue portion 15 so that it can be held in various positions such as the open position shown by the dashed line in FIG. 2.

Figure 4:
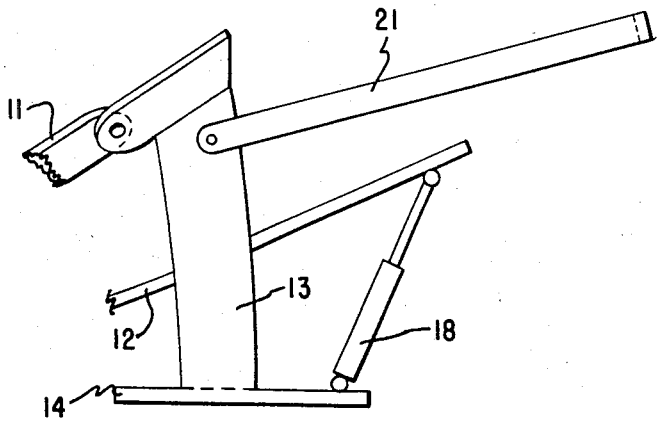
FIG. 4 is a partial view similar to FIG. 2 showing auxiliary handles for use with the device.

On the upper end of the tongue I prefer to form a paddle 17 which can readily be engaged by the user's hand or foot. Thus, when the device is standing on its base 14, pressure downward by hand or foot on the paddle 17 will move the tongue downward so that the wider part 15 can be caught and held in a depressed position by the notches 16. It will be obvious to those skilled in the art that a penumatic or hydraulic cylinder 18 or even a mechanical device such as a cable and pulleys or the like could be engaged between the base 14 and the paddle 17 to perform the same function of spreading the stocking. (See FIG. 4).

In order to hold material on the rails 11, I prefer to form serrations 17 on the edges of the rails. These serrations should be sufficient to hold the stocking material but should not be so sharp as to break any of the threads. Similar serrations 21 should be provided on the underside of the tongue for the same purpose.

In normal use, the tongue 12 could simply be a smooth piece of material over which a foot could slide. However, if easier movement of the foot over the device is desired, I propose to use a sliding belt 19 entrained over a pair of rollers 20. Another alternative might be to use a series of rollers in place of the belt. If either the belt or the series of rollers is used, the underside serrations 21 on the tongue 12 should be used and can be placed so as to sandwich the belt or rollers between the serrations.

Figure 2:
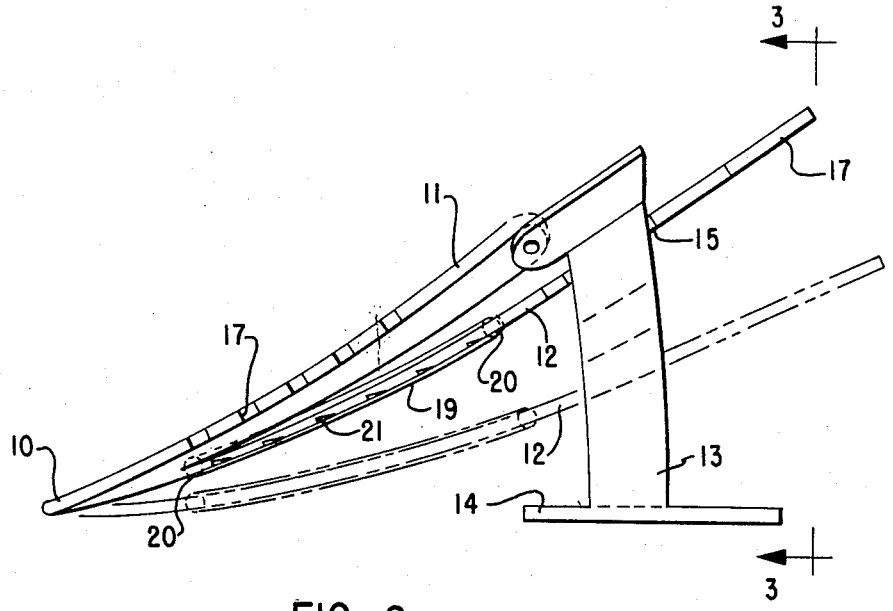
FIG. 2 is a side elevational view of the device of FIG. 1, showing the central tongue in two alternate portions.
Figure 3:
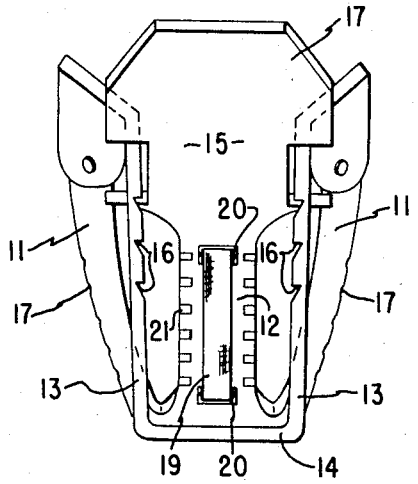
FIG. 3 is an elevational view from line 3—3 of FIG. 2.

In use, with the tongue 12 in the full upward position as shown in FIG. 2 in full lines, the tip 10 of the device is inserted into the open end of a stocking. (Ordinarily this would be an elastic stocking although my device will also work with ordinary hosiery also.) The stocking is then pulled up over the rails 11 until the tip 10 projects into the foot of the stocking, and perhaps into the toe. This results in the body of the stocking being bunched up along the rails 11. The device is then placed on its base 14, and the tongue 12 is depressed by pressure of hand or—more likely—the foot on the paddle end 17. When the tongue 12 is depressed to the desired notch 16, the pressure can be released and the tongue will be held in the notch. At that point, the stocking is stretched open for substantially its full length.

The foot and leg of the stocking wearer can then be easily inserted into the open stocking. Ordinarily the belt 19 would be unnecessary, and I prefer to use the device without the belt. However, for certain uses where a heel might stick on the tongue or for particularly feeble users, the belt may make insertion of the foot in the stocking somewhat easier. Also, for users who are not able to reach down and hold the device while inserting their foot into the stocking, I can provide handles 21 to be held to pull the device against the pressure of the foot going into the stocking. It will be obvious that these can either be stiff, bar-type handles or flexible strap-like means.

After the stocking has been completely pulled off of the rails 11, the legs 13 of the stand can be separated by pulling the tops apart. This will release the tongue 12 from the notches 16. The tongue 12 will then spring back into place for the placement of the next stocking.

I claim as my invention:

1. A device comprising rail means arranged to spread a stocking, tongue means resiliently mounted on said rail means, said rail means and tongue means being normally in a nearly planar relation, said tongue means being movable to a displaced position out of said planar relation, means to hold said tongue means in said displaced position whereby a stocking disposed over said rail means will be held open for the insertion of a user's foot and leg.

2. The device of claim 1 in which said means to hold the tongue means in the displaced position includes legs attached to said rail means and adapted to engage said tongue means in a holding relationship.

3. The device of claim 2 in which said legs are attached to a base, said base and said rail means being adapted to support said device.

4. The device of claim 3 in which said rail means includes a rounded end adapted to be inserted into said stocking.

5. The device of claim 3 in which said legs are resiliently pressed toward each other by their attachment to said base, said legs being formed with notches in the surface facing the opposite leg, said tongue being formed to engage both legs in a spreading engagement whereby said tongue may be caught in and retained by said notches.

6. The device of claim 3 in which said tongue means is formed with a surface smooth enough so that a user's heel will slide readily on said tongue means.

7. The device of claim 3 in which said tongue means includes a pair of rollers journalled on axes transverse of said tongue means and spaced longitudinally on said tongue means, belt means running between said rollers having one surface above and one surface below said tongue means whereby the user's heel will slide smoothly above said tongue means.

8. The device of claim 3 in which powered means is engaged between said tongue and said base, said powered means being adapted to pull said tongue toward said base to spread open said stocking.

9. The device of claim 5 in which handles are fastened to said legs whereby said device can be pulled up the user's leg.

10. The device of claim 4 in which said base and said rounded end provide the support for said device, said tongue means including an end extending beyond said legs, said end being adapted for contact by which it can be depressed to move said tongue to said displaced position.

* * * * *